United States Patent [19]

Domenichiello

[11] Patent Number: 4,970,844

[45] Date of Patent: Nov. 20, 1990

[54] METHOD AND APPARATUS FOR MAKING A BALLOON CONTAINER

[75] Inventor: Peter Domenichiello, Mississauga, Canada

[73] Assignee: Surprize Enterprise Inc., Ontario, Canada

[21] Appl. No.: 293,362

[22] Filed: Jan. 4, 1989

Related U.S. Application Data

[62] Division of Ser. No. 88,564, Aug. 24, 1987, Pat. No. 4,811,841.

[30] Foreign Application Priority Data

May 23, 1987 [CA] Canada ..... 540423

[51] Int. Cl.[5] ..... B65B 7/28; B65B 25/02; B65B 31/04; B67B 5/00

[52] U.S. Cl. ..... 53/433; 53/434; 53/441; 53/457; 53/459; 53/487; 53/511; 53/512; 53/556; 53/564; 53/290; 53/291

[58] Field of Search ..... 53/434, 459, 457, 570, 53/385, 390, 258, 260, 262, 433, 473, 441, 291, 478, 487, 433, 290; 137/1, 223, 268, 584; 446/220, 222, 223, 226

[56] References Cited

U.S. PATENT DOCUMENTS

| | | | |
|---|---|---|---|
| Re. 30,531 | 3/1981 | Spector | 47/69 |
| 1,218,314 | 3/1917 | Read | 53/262 X |
| 1,828,295 | 10/1931 | Roy . | |
| 1,951,777 | 3/1934 | Siegler et al. | 47/41 |
| 2,847,805 | 8/1958 | Robbins | 53/24 |
| 2,900,779 | 8/1959 | Baxter et al. | 53/390 X |
| 2,962,803 | 12/1960 | Jones | 53/258 X |
| 2,994,424 | 8/1961 | Selby et al. | 206/46 |
| 3,298,156 | 1/1967 | Lerner | 53/385 X |
| 3,807,130 | 4/1974 | Pedersen | 53/258 |
| 3,827,210 | 8/1974 | Smalley et al. | 53/258 X |
| 3,869,828 | 3/1975 | Matsumoto | 47/34.11 |
| 4,118,890 | 10/1978 | Shore | 47/28 |
| 4,183,194 | 1/1980 | Lucke | 53/385 X |
| 4,203,269 | 5/1980 | Petersen | 53/258 X |
| 4,221,078 | 9/1980 | Latham et al. | 47/41 |
| 4,704,934 | 11/1987 | Nosrati | 446/220 X |
| 4,737,133 | 4/1988 | Neumeier | 446/222 X |
| 4,809,484 | 3/1989 | Lovik | 53/434 |

FOREIGN PATENT DOCUMENTS

| | | |
|---|---|---|
| 24108 | 9/1950 | Finland . |
| 2061863 | 5/1981 | United Kingdom . |

*Primary Examiner*—Horace M. Culver
*Attorney, Agent, or Firm*—Bacon & Thomas

[57] ABSTRACT

A device and method of constructing articles of fresh cut parts of plants and artificial decorative embodiments. The packaging is characterized by enveloping such articles with an inflated balloon. The article being placed in an open container, a balloon is then inflated and receives the article and container and is then securely attached to the container, thereby enclosing the article. A device for constructing the packaged article employs a rigid conduit which is received in the balloon to facilitate reception of the article and container. The gas used to inflate the balloons can be air or nitrogen. If cut flowers are used, the container is provided with some water and plant food.

33 Claims, 2 Drawing Sheets

METHOD AND APPARATUS FOR MAKING A BALLOON CONTAINER

This application is a divisional of co-pending U.S. patent application Ser. No. 07/088,564 filed Aug. 24, 1987, now U.S. Pat. No. 4,811,841 dated Mar. 14, 1989.

BACKGROUND OF THE INVENTION

This invention relates to packaging fresh cut parts of plants, such as leaves or flower-bearing stems, or artificial embodiments thereof, and like-sized articles which are displayed for their ornamental appeal; and to supplementing such ornamental appeal.

To improve longevity, such articles require care and protection from damage that may result from accidental striking or dropping, as during transport. To improve appearance, it is useful to prevent accumulation of dust and other air-borne particles on such articles.

It is an object of this invention to provide a packaging designed to improve the longevity and appearance of such articles, and to add ornamental features.

It is a further object of this invention to provide a new method and machine for packaging and displaying decorative articles such as cut flowers.

SUMMARY OF THE INVENTION

According to one aspect of the invention there is provided a process for packaging a decorative article, comprising the sequential steps of disposing the article in a gas-impermeable container with an upwardly opening port so that a substantial portion of said article projects above the port of the container, inflating a balloon, enveloping the substantial portion of the article from the top with the balloon so inflated, and securing sealingly the balloon so inflated to the port of the container.

In another aspect of the invention, there is provided a device for packaging an article in a container, comprising a source of pressurized gas, an elongate chamber, open at one end, adapted to receive the article and container, and having means for communicating with the source of pressurized gas so that the gas is delivered when required into the chamber, holding means within said chamber for holding the article and container during movement thereof within the chamber, actuation means secured to the chamber and connected to the holding means for axially moving the holding means within the chamber, and control means for controlling the actuation means and flow of the pressurized gas into the chamber.

According to another aspect of the invention, there is provided a package combination comprising an article, a container having a top and a neck and adapted to receive and hold the article through an opening in the top, the container being gas-impermeable except at the top, an inflated balloon secured to the container in a gas-tight relationship with the neck, whereby the combination of the container and the balloon completely encloses the article.

By way of example, a preferred embodiment of the present invention, and of the process and device for constructing same, is described below in conjunction with the accompanying drawings.

DETAILED DESCRIPTION OF THE PREFERRED EMBODIMENTS

Figure 1:
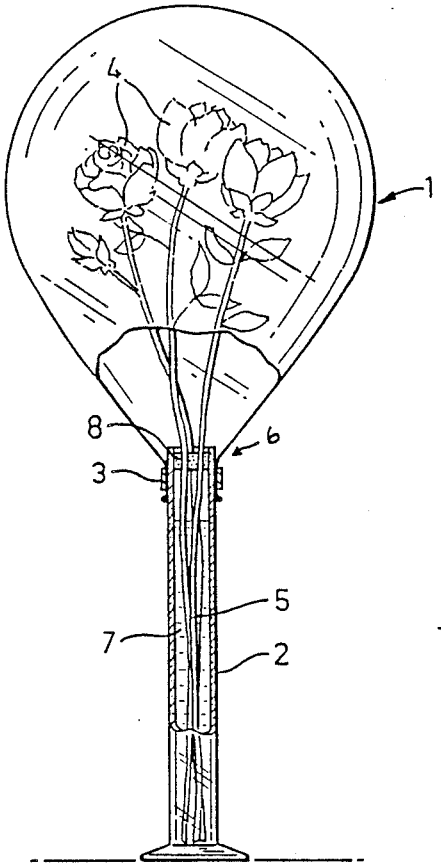
FIG. 1 is a front perspective view, partially broken, of packaged fresh cut flowers, constructed in accordance with the present invention.
Figure 2:
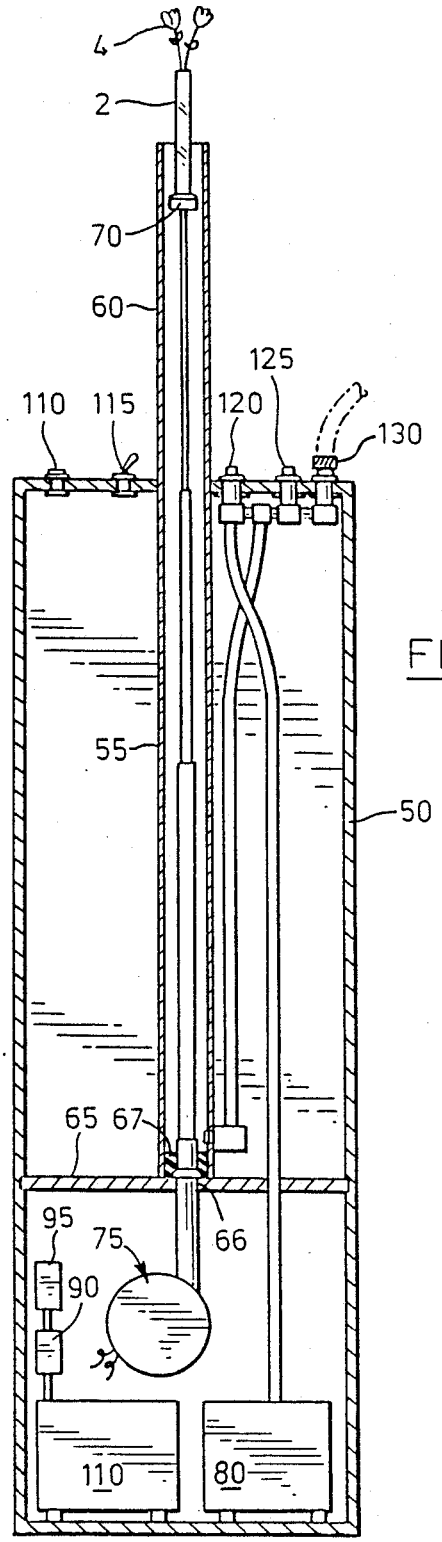
FIG. 2 is a front sectional view of a device for constructing the packaged flowers, as shown in FIG. 1, wherein a vase and flowers are being lowered into the device.
Figure 3:
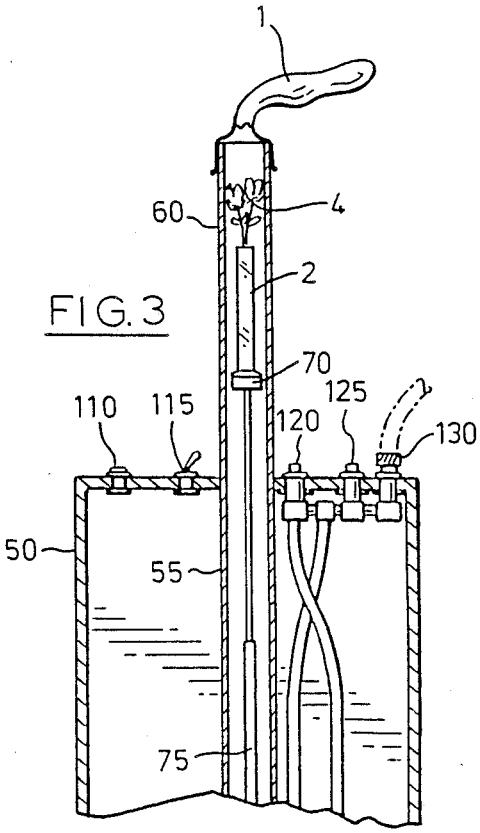
FIG. 3 is a partial front sectional view of the device, when the vase and flowers have been lowered into the device and the balloon has been attached and is being inflated.

In FIG. 1, there is shown an inflated conventional balloon 1 and vase 2 connected in a gas-tight relationship by annular sealing band 3. Balloon 1 and vase 2 may be transparent, coloured or marked in any ornamentably desirable fashion. Vase 2 is of conventional construction (having in particular a fluid and gas-tight construction and an open top) and is of a conventional profile adapted to receive and hold stems 5 of fresh cut flowers 4, and having a neck 6 small enough to allow balloon 1 to snuggly receive it. Balloon 1 is of a type conventionally available and preferably clear, and is inflatable to accommodate flowers 4. Balloon 1 may be inflated with air or other gases conducive to flowers 4; nitrogen gas or oxygen are usable for this purpose. Water and conventionally available nutrients 7 for flowers 4 are provided in vase 2. A foraminous annular securing device 8 which can be of known construction, is snuggly disposed within vase 2 to securely arrange stems 5. Referring to the device in FIGS. 2 and 3, disposed in a cabinet 50 there is a vertically disposed cylindrical chamber 55 with an internal diameter sufficient to receive slidably vase 2 and flowers 4. The internal height of chamber 55 is sufficient to accommodate at least the combined height of vase 2 and flowers 4 arranged therein. Chamber 55 is open on the top with top portion 60 and is closed at the bottom, sealingly secured to a horizontal shelf 65 of cabinet 50 by conventional means, such as welding and a silicon seal at 67.

There is a disc platform 70 elevatable or lowerable within chamber 55 by conventional telescopic actuation means 75 disposed under shelf 65 and extending upward therethrough at bore 66. Conventional means, such as welding and silicon seals, are provided at 67 to seal and secure actuation means 75 to chamber 55 in a gas-tight relationship. A conventional automatic car antenna actuator (for example, HARADA MXI) may be employed as actuation means 75 which includes a telescoping tubular member movable longitudinally in the chamber. Platform 70 has a diameter less than the internal diameter of the chamber 55 so as to form an annular orifice and is profiled to shoulder vase 2 in a stable manner as it is lowered or elevated.

There is conventional air pumping means, designated as 80, which is disposed near chamber 55 and is in controlled communication therewith through switch-valve means 120. Additionally, there is an auxilliary conventional coupler 130, adapted to receive pressurized gas from an external source (not shown), connected to conventional valve 125 which controls communication with chamber 55.

Figure 4:
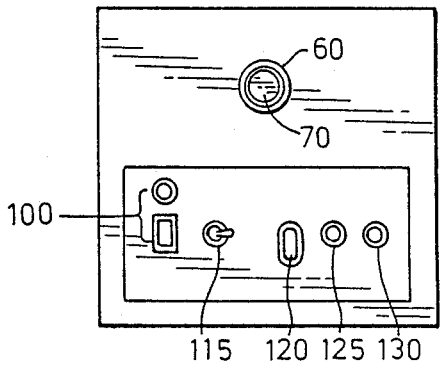
FIG. 4 is a top view of the device illustrated in FIGS. 2 and 3.

For carrying out the process of packaging, to be described below, there are electric control means as illustrated in circuit schematic form in FIG. 5, and illustrated in the top schematic view of the device in FIG. 4.

Figure 5:
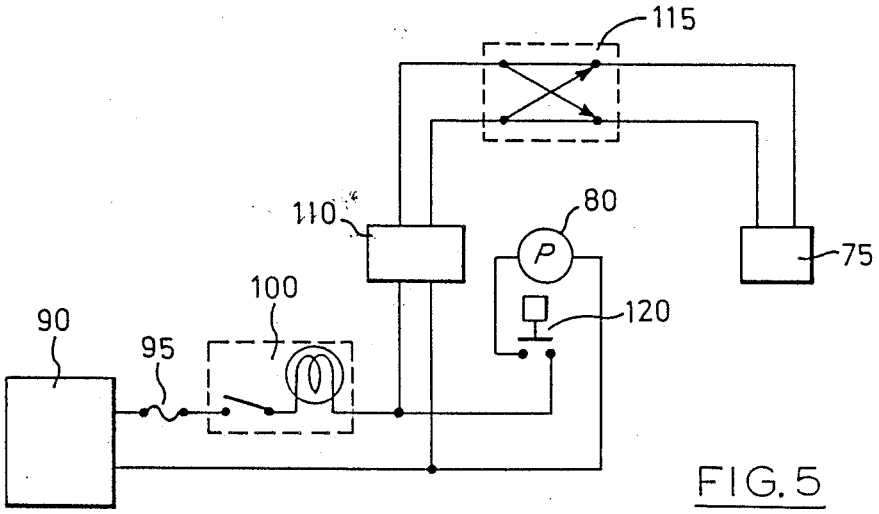
FIG. 5 is a circuit schematic of the electric control means for the device illustrated in FIGS. 2 to 4.

In FIG. 5, a conventional 120 volt AC source is designated at 90 and is connected to a step down transformer and converter, generally designated as 110, and is controlled by fuse or circuit breaker 95 and switch and on-light combination 100. Conventional transformer and converter 110 step down and convert 120 volts AC to 12 volts DC, which is then fed to actuation means 75 and controlled by switch means 115. Source 90 is also connect to air pumping means 80, which is controlled by conventional switch 120.

The process of constructing the packaged plant with the above described device is as follows. Flowers 4 and stems 5 are arranged in vase 2, as hereinbefore described, and platform 70 is raised within the chamber 55 by actuation means 75 to a height that permits the manual placement of vase 2 on platform 70 without undue difficulty. So placed, platform 70 is lowered by actuation means 75 until the top of flowers 4 is below the top of the chamber 55. Balloon 1 is then manually placed over the top portion 60 of chamber 55 in a gas-tight relationship therewith. Air is pumped into chamber 55 to inflate balloon 1 to the desired size, usually large enough to enclose flowers 4 without contact therewith. After inflation, vase 2 and flowers 4 are elevated into inflated balloon 1 by actuation means 75 until a portion of vase 2 is exposed above top portion 60 of chamber 55. At this stage, flowers 4 will be enveloped by inflated balloon 1. Balloon 1 is then manually slid off top portion 60 of chamber 55 to grip the said exposed portion of vase 2, which grip is further secured by elastic band 3 so as to form a gas-tight relationship between balloon 1 and vase 2.

As with any fresh cut flowers, it is preferable to keep the packaged plant, as hereinabove described, in a cool, dry environment.

Variations to the above described preferred embodiment within the spirit of the invention include the following. It will be apparent that articles like feathers, dehydrated plants, small toys like plush dolls and decorative seeds on suitable stems may be packaged according to the invention. Different sizes of vases and articles may be packaged through appropriate and routine modification of the above described process. Platform 70 may be perforated to permit easier flow of gas therethrough. For fresh cut flowers, it has been found that nitrogen gas is a suitable gas. According to the physical characteristics and requirements of the articles packaged, balloons of different characteristics may be employed to enhance the longevity of the packaged articles, including those characteristics related to the permeability of oxygen, carbon dioxide and water. Alternatively, appropriate coatings may be applied to the balloon to prevent the formation of water droplets in the balloon or to maintain the shine of the balloon. For example, coating the outer surface of the inflated balloon with thinned Hi-Float(*) coating (one part Hi-Float to three parts water) has been to prolong the shine.

(*) Hi-Float is a trade mark of Hi-Float Company of Louisville, Ky.

I claim:

1. A process for packaging a decorative article, comprising the sequential steps of:

(a) disposing the article in a gas-impermeable container with an upwardly opening port so that a substantial portion of said article projects above said port of the container;

(b) inflating a balloon;

(c) enveloping said substantial portion of the article from the top with said balloon so inflated;

(d) securing sealingly said balloon so inflated to said port of said container.

2. A process according to claim 1, wherein said enveloping is achieved by introducing a rigid conduit into said balloon, and moving said article and container through said conduit and partially into said balloon.

3. A process according to claim 2, wherein said conduit has one open end and is otherwise closed, and is in controlled communication with a source of gas, and said enveloping and inflating comprises the steps of lowering said article and container into said conduit, securing sealingly said balloon over said open end of said conduit, inflating said balloon by pumping said gas through said conduit, and raising said container and article so that they are partially within said balloon.

4. A process according to claim 1 wherein said securing is achieved by friction gripping said balloon around said container by means of an elastic band.

5. A process according to claim 4 further comprising the step of adding nutrients to said container.

6. A device for packaging an article in a container comprising:

(a) a source of pressurized gas;

(b) an elongate chamber, open at one end, adapted to receive the article and container, and having means for communicating with said source of pressurized gas so that said gas is delivered when required into said chamber;

(c) holding means within said chamber for holding and supporting the article and container during movement thereof within said chamber;

(d) actuation means secured to said chamber and connected to said holding means for axially moving said holding means within said chamber;

(e) control means for controlling said actuation means and flow of said pressurized gas into said chamber.

7. A device according to claim 6 wherein said chamber is cylindrical in shape.

8. A device according to claims 6 wherein said holding means is a plate dimensioned sufficiently small to permit flow of said gas around said plate within said chamber.

9. A device according to claims 6 wherein said holding means is a perforated plate.

10. A device according to claim 6 wherein the said actuation means is a piston actuated by hydraulic means.

11. A device according to claim 6 wherein the said actuation means is a piston actuated by an electric motor.

12. A process for packaging a decorative article, comprising the sequential steps of:

(a) disposing the article in a container having a top and a neck, and being gas-impermeable except at said top, said article extending through an opening i said top so that there is a substantial exposed section of the article above said top;

(b) inflating a balloon;

(c) enveloping said exposed section of the article with said inflated balloon;

(d) securing sealingly said inflated balloon to said neck of said container.

13. A process according to claim 12 wherein said balloon is inflated by introducing a rigid conduit into said balloon and allowing pressurized gas to enter said balloon through said conduit, and said enveloping is achieved by moving said article through said conduit until said exposed section is positioned within said balloon.

14. A device for packaging an article in a container comprising:

(a) an elongate chamber, open at one end, adapted to receive a combination of the article and container, and having means for communicating with a source of pressurized gas so that said gas can be delivered into said chamber;

(b) support means within said chamber for supporting the article and container within said chamber;

(c) means for permitting a desired amount of relative movement between said support means and said chamber in the longitudinal direction of said chamber, wherein said support means can be moved relative to said chamber to project a substantial portion of the combined article and container out the open end of the chamber for packaging purposes.

15. A device according to claim 14 wherein said chamber is cylindrical in shape and its open end is adapted to receive about the exterior of the chamber a neck of a balloon.

16. A device according to claim 14 wherein said support means is an apertured plate to permit flow of said gas through said plate within said chamber.

17. A device according to claim 14 wherein said means for permitting movement comprises actuation means connected to said support means for moving said support means longitudinally in said chamber.

18. A device according to claim 17 wherein said actuation means includes a tubular member movable longitudinally in said chamber.

19. A device according to claim 14 including a source of pressurized gas and means for controlling the flow of pressurized gas from said source into said chamber.

20. A method of introducing an object into an inflated balloon comprising:

(a) disposing the object to be introduced within an elongated chamber, open at one end and sealed at the other end;

(b) placing the open neck of an uninflated balloon over the open end of said elongated chamber in a gas-tight relationship therewith;

(c) inflating the balloon by injecting pressurized gas into the elongated chamber;

(d) moving the object axially within the elongated chamber until it is introduced into the inflated balloon through the open end of the elongated chamber;

(e) removing the inflated balloon from the open end of the elongated chamber; and (f) sealing the balloon with the object introduced therein.

21. The method according to claim 20, wherein the object is introduced into the balloon while the elongated chamber is vertically disposed and using a cylindrical chamber as the elongated chamber.

22. The method according to claim 20, wherein said object comprises fresh cut parts of plants disposed in a gas-impermeable container with an upwardly opening port so that a substantial portion of said article projects above said port of said container.

23. The method according to claim 22, wherein said fresh cut parts of plants are fresh cut flowers.

24. The method according to claim 22, further comprising the step of adding water and plant nutrients to said container.

25. The method according to claim 20, wherein said pressurized gas is air.

26. The method according to claim 20, wherein said pressurized gas is nitrogen.

27. The method according to claim 20, wherein said object is a small toy.

28. The method according to claim 20, wherein said object is a plush doll.

29. A device for inflating and introducing an object into a balloon comprising:

(a) an elongated chamber, open at one end and sealed at the other end and adapted to receive an object to be introduced;

(b) means within said elongated chamber for engaging said object and moving said object axially within said chamber and through the open end of said chamber; and (c) means for connecting the interior of said chamber to a source of pressurized gas so that said gas is delivered when required into said chamber.

30. The device according to claim 29, wherein said elongated chamber is a vertically disposed cylindrical chamber.

31. The device according to claim 29, wherein said means for engaging and moving said object comprises a plate dimensioned sufficiently small to permit flow of said gas around said plate within said chamber.

32. The device according to claim 29, wherein said means for engaging and moving said object comprises a perforated plate.

33. The device according to claim 29, further comprising actuation means for moving said means for engaging and moving said object axially within said elongated chamber.

* * * * *